US011933518B2

(12) United States Patent
Huang

(10) Patent No.: US 11,933,518 B2
(45) Date of Patent: Mar. 19, 2024

(54) DAMPING ASSEMBLY FOR AIR CONDITIONER AND AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventor: Huoxu Huang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 265 days.

(21) Appl. No.: 16/802,889

(22) Filed: Feb. 27, 2020

(65) Prior Publication Data

US 2021/0164689 A1 Jun. 3, 2021

Related U.S. Application Data

(63) Continuation of application No. PCT/CN2019/125309, filed on Dec. 13, 2019.

(30) Foreign Application Priority Data

Nov. 29, 2019 (CN) ..... 201911204880.3
Nov. 29, 2019 (CN) ..... 201922129771.1

(51) Int. Cl.
*F24F 13/24* (2006.01)

(52) U.S. Cl.
CPC ..... *F24F 13/24* (2013.01)

(58) Field of Classification Search
CPC ..... F24F 13/24; F24F 13/32; F24F 13/0254; F24F 1/12; F24F 1/40
See application file for complete search history.

(56) References Cited

U.S. PATENT DOCUMENTS 1,316,255 A * 9/1919 Rauch ..... F16L 3/2235 248/68.1
4,605,059 A * 8/1986 Page ..... F28D 7/024 165/DIG. 414
6,702,237 B2 * 3/2004 Rubenstein ..... F16L 3/003 248/65
2010/0025548 A1 * 2/2010 Grivas ..... F24F 13/0254 248/62

FOREIGN PATENT DOCUMENTS

CN 205807957 U * 12/2016
CN 207113066 U * 3/2018 ..... F24F 1/26
EP 1852662 A1 * 11/2007 ..... F24F 13/0254

OTHER PUBLICATIONS

English Machine Translation CN 207113066. Accessed Jan. 2022.*

* cited by examiner

*Primary Examiner* — Tavia Sullens
(74) *Attorney, Agent, or Firm* — Anova Law Group, PLLC

(57) ABSTRACT

A damping assembly includes a damping pad including a connection base and a damping body connected to the connection base and extending in a direction away from the connection base. The damping body includes a plurality of mounting holes configured to hold refrigerant pipes of an air conditioner. Each of the mounting holes includes a mounting opening configured to allow one of the refrigerant pipes to be snapped through, and at least two of the plurality of mounting holes are arranged along an extension direction of the damping body.

16 Claims, 3 Drawing Sheets

DAMPING ASSEMBLY FOR AIR CONDITIONER AND AIR CONDITIONER

CROSS-REFERENCE TO RELATED APPLICATIONS

This application is a continuation of International Application No. PCT/CN2019/125309, filed on Dec. 13, 2019, which is based on and claims priority to Chinese Patent Applications Nos. 201911204880.3 and No. 201922129771.1, both filed on Nov. 29, 2019, the entire contents of all of which are incorporated herein by reference.

FIELD

The present application relates to the air conditioning field, and particularly to a damping assembly for an air conditioner and an air conditioner.

BACKGROUND

In related art, refrigerant pipes of an air conditioner (for example, a window air conditioner) tend to come into contact with one another due to collisions during long-distance transportation, or a poor operation during production, thereby generating noises in the operation of the air conditioner, which greatly affects the use comfortability of a user.

SUMMARY

The present application seeks to solve at least one of the problems existing in the related art to at least some extent. To this end, one object of the present application is to provides a damping assembly for an air conditioner, capable of reducing operating noises of the air conditioner effectively, and improving the flexibility of use.

The present application also provides an air conditioner having the above-mentioned damping assembly.

A damping assembly for an air conditioner according to an embodiment of a first aspect of the present application includes: a damping pad provided with a plurality of mounting holes for refrigerant pipes to pass through. Each of the mounting holes is provided with a mounting opening, and at least two of the plurality of mounting holes are arranged in an up-and-down direction.

In the damping assembly for an air conditioner consistent with embodiments of the present application, a plurality of refrigerant pipes are spaced apart from one another by means of the plurality of mounting holes at the damping pad, which may prevent the refrigerant pipes from coming into contact with one another in the case of transportation or poor operation, thereby further reducing the noises caused by the contact of the refrigerant pipes during the operation of the air conditioner and improving the flexibility of use of the air conditioner. At the same time, by arranging at least two of the plurality of mounting holes in the vertical direction, the arrangement of the refrigerant pipes is optimized, and an inner space of the air conditioner is made full use, thereby making the structure of the air conditioner more compact and facilitating the reduction of an overall volume of the air conditioner.

According to some embodiments of the present application, the damping pad includes: a connection base; a damping body, including a first damping member and a second damping member, each of the first and second damping members being provided with the mounting hole, one end of the first damping member and one end of the second damping member being both connected to the connection base, and the other end of the first damping member and the other end of the second damping member being both movable in directions apart from and towards each other.

According to some embodiments of the present application, a mounting opening of the mounting hole in the first damping member is formed at a side of the first damping member adjacent to the second damping member, and a mounting opening of the mounting hole in the second damping member is formed at a side of the second damping member adjacent to the first damping member.

According to some embodiments of the present application, the first damping member and the second damping member are spaced apart from each other.

According to some embodiments of the present application, in a direction away from the damping body, a width of the connection base is decreased gradually.

According to some embodiments of the present application, the damping pad is configured as an integrally molded part.

According to some embodiments of the present application, the damping pad is configured as a silicone part, a rubber part or a plastic part.

According to some further embodiments of the present application, a fixation bracket is further provided, and is connected to the damping pad and a housing of the air conditioner.

According to some embodiments of the present application, the fixation bracket is connected with the damping pad by a snapping assembly, the snapping assembly includes a snap and a groove, the snap is provided at one of the fixation bracket and the damping pad, and the groove is formed at the other one of the fixation bracket and the damping pad.

According to some embodiments of the present application, the fixation bracket is formed with an accommodation groove with an opening facing downward, and the damping pad is accommodated in the accommodation groove.

According to some embodiments of the present application, at least one inner wall surface of the accommodation groove abuts against and is fitted with the damping pad.

According to some embodiments of the present application, the fixation bracket is configured as a plastic part, a sheet metal part, a rubber part, or a silicone part.

An air conditioner according to an embodiment of a second aspect of the present application includes the damping assembly consistent with embodiments of the first aspect of the present application.

In the air conditioner consistent with embodiments of the second aspect of the present application, by providing the damping assembly consistent with embodiments of the above-mentioned first aspect of the present application, the noises caused by the contact of the refrigerant pipes during the operation of the air conditioner are reduced, and the flexibility of use of the air conditioner is improved. At the same time, the structure of the air conditioner may be made more compact and the reduction of an overall volume of the air conditioner is facilitated.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

The above and/or additional aspects and advantages of the present application will become apparent and more readily appreciated from the following descriptions made with reference to the drawings, in which.

Figure 1:
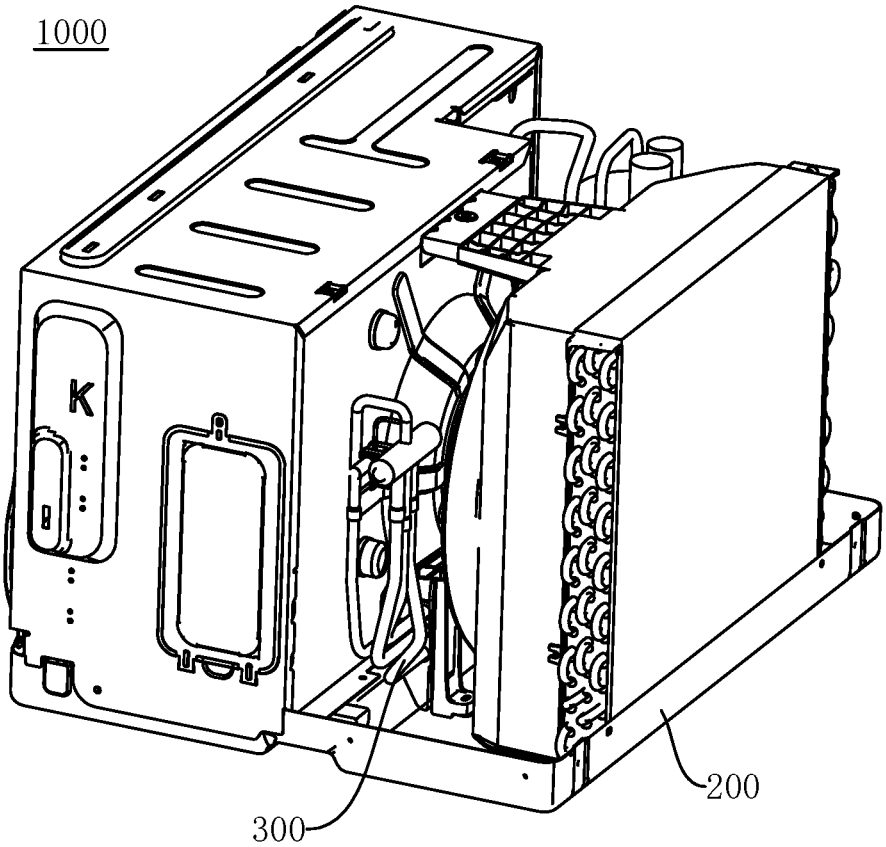
FIG. 1 is a perspective view of an air conditioner according to an embodiment of the present application.

REFERENCE NUMERALS damping assembly 100, damping pad 1, mounting hole 10, mounting opening 101, connection base 11, damping body 12, first damping member 121, second damping member 122, fixation bracket 2, accommodation groove 21, connection member 22, fixation hole 221, snap 31, groove 32, air conditioner 1000, chassis 200, refrigerant pipe 300.

DETAILED DESCRIPTION

Reference will be made in detail to embodiments of the present application, and the examples of the embodiments are illustrated in the drawings, where the same or similar elements and the elements having same or similar functions are denoted by like reference numerals throughout the descriptions. The embodiments described herein with reference to drawings are illustrative, and merely used to explain the present application. The embodiments shall not be construed to limit the present application.

Hereinafter, a damping assembly 100 for an air conditioner 1000 according to an embodiment of the present application will be described with reference to the drawings. As shown in FIG. 1, the air conditioner 1000 may be configured as a window air conditioner, but is not limited thereto. In the following description, the air conditioner 1000 is explained by taking a window air conditioner as an example.

The damping assembly 100 for an air conditioner 1000 consistent with embodiments of the first aspect of the present application includes damping pad 1, provided with a plurality of mounting holes 10 suitable for a refrigerant pipe 300 to pass through, each of the mounting holes 10 provided with a mounting opening 101. In the description of the present application, "a plurality of" means two or more. The specific number and arrangement of mounting holes 10 may be adjusted and determined according to actual conditions.

Figure 2:
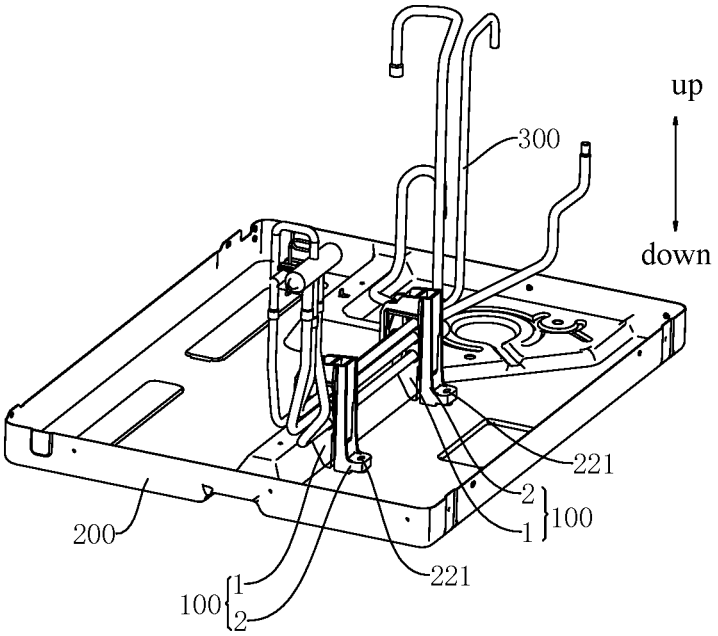
FIG. 2 is a schematic diagram of an internal structure of the air conditioner according to an embodiment of the present application.

Referring to FIG. 2, a plurality of refrigerant pipes 300 are provided, and are in one-to-one correspondence with the plurality of mounting holes 10. Each of the refrigerant pipes 300 penetrates through its corresponding mounting hole 10. Specifically, the refrigerant pipe 300 may be snapped in the mounting hole 10 via the mounting opening 101 of the mounting hole 10. Thus, the plurality of refrigerant pipes 300 may be spaced apart by the damping pad 1 to prevent the refrigerant pipes 300 from coming into contact with one another in the case of transportation or poor operation, thereby further reducing the noises caused by the contact of the refrigerant pipes 300 during the operation of the air conditioner 1000 and improving the flexibility of use of the air conditioner 1000.

Specifically, at least two of the plurality of mounting holes 10 are arranged in a vertical direction. The above-mentioned at least two of the mounting holes 10 may also be aligned or staggered in the vertical direction. That is, the upper mounting hole 10 may be located directly or diagonally above the lower mounting hole 10. Thus, the arrangement of the refrigerant pipes 300 may be optimized, the inner space of the air conditioner 1000 is made full use, thereby making the structure of the air conditioner 1000 more compact and facilitating the reduction of an overall volume of the air conditioner 1000.

Figure 3:
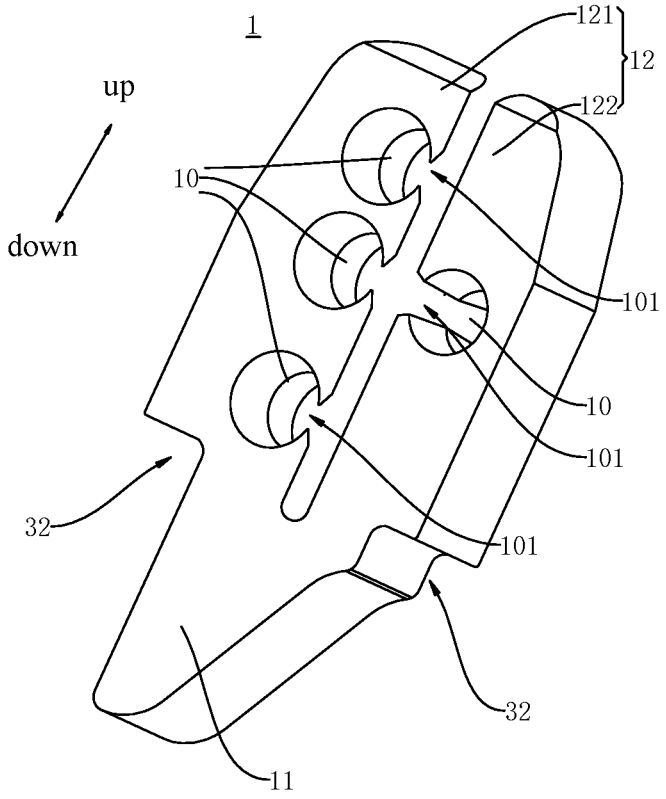
FIG. 3 is a perspective view of a damping pad of a damper assembly according to an embodiment of the present application.
Figure 4:
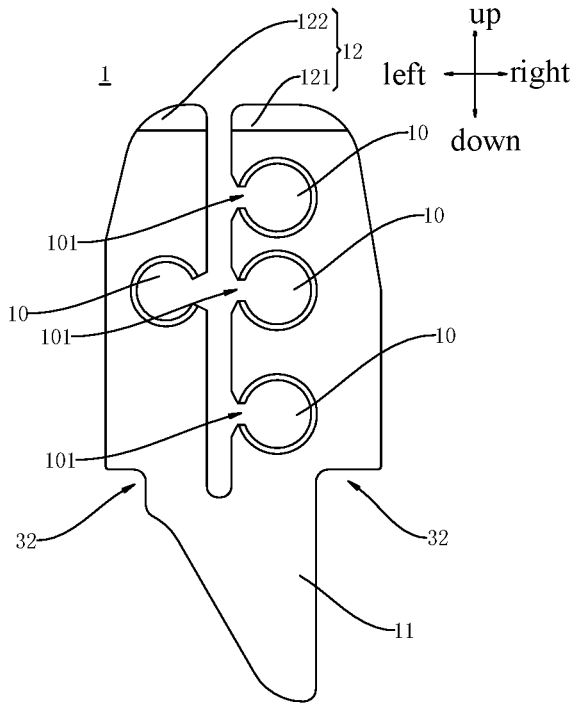
FIG. 4 is a front view of a damping pad of a damper assembly according to an embodiment of the present application.
Figure 5:
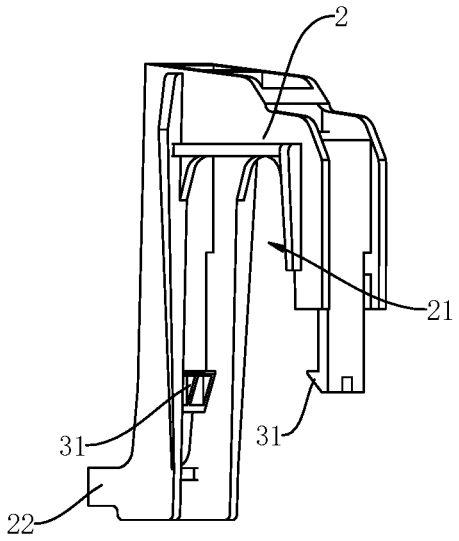
FIG. 5 is a perspective view of a fixation bracket of the damper assembly according to an embodiment of the present application.
Figure 6:
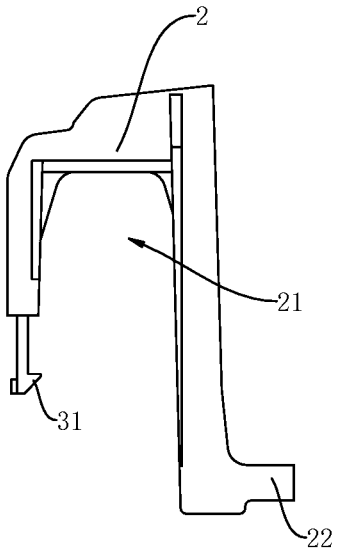
FIG. 6 is a front view of the fixation bracket of the damper assembly according to an embodiment of the present application.

For example, in some embodiments of the present application, referring to FIGS. 3 and 4, the damping pad 1 is provided with four mounting holes 10. Three of the four mounting holes 10 are arranged in a vertical column in the vertical direction, and the fourth one of the four mounting holes 10 is aligned with one of the above-mentioned three mounting holes 10. In other embodiments of the present application (not shown), the damping body 12 can be provided with four mounting holes 10, where two mounting holes 10 are provided at both the first and second damping members 121, 122, and the four mounting holes 10 are arranged at four corners of a quadrangle.

In the description of the present application, it is to be understood that terms such as "upper," "lower," "top," "bottom," "inner," "outer," "left," "right" should be construed to refer to the orientation as then described or as shown in the drawings under discussion. These relative terms are for convenience of description and do not require that the present application be constructed or operated in a particular orientation, thus cannot be construed to limit the present application.

In the damping assembly 100 for an air conditioner 1000 consistent with embodiments of the present application, the plurality of refrigerant pipes 300 are spaced apart from one another by means of the plurality of mounting holes 10 at the damping pad 1, which may prevent the refrigerant pipes 300 from coming into contact with one another in the case of transportation or poor operation, thereby further reducing the noises caused by the contact of the refrigerant pipes 300 during the operation of the air conditioner 1000 and improving the flexibility of use of the air conditioner 1000. At the same time, by arranging at least two of the plurality of mounting holes 10 in the vertical direction, the arrangement of the refrigerant pipes 300 is optimized, and an inner space of the air conditioner 1000 is made full use, thereby making the structure of the air conditioner 1000 more compact and facilitating the reduction of an overall volume of the air conditioner 1000.

According to some embodiments of the present application, the damping pad 1 includes: a connection base 11 and a damping body 12 connected to the connection base 11 and extending in a direction away from the connection base 11. As shown in, e.g., FIGS. 3 and 4, at least two of the plurality of mounting holes 10 are arranged in an extension direction of the damping body 12. The damping body 12 includes a first damping member 121 and a second damping member 122, each of the first and second damping members 121, 122 is provided with at least one mounting hole 10, one end of the first damping member 121 and one end of the second damping member 122 are connected to the connection base 11, and the other end of the first damping member 121 and the other end of the second damping member 122 are movable in directions apart from and towards each other. Thus, the refrigerant pipe 300 may be snapped into the mounting hole 10 via the mounting opening 101 conveniently, thereby reducing the assembly difficulty and improving an assembly efficiency.

It is understood that at the time of assembly, the first and second damping members 121, 122 are movable at different or the same time.

For example, referring to FIGS. 3 and 4, a lower end of the first damping member 121 and a lower end of the second damping member 122 are both connected to the connection base 11, and an upper end of the first damping member 121 and an upper end of the second damping member 122 are movable in directions apart from and towards each other. At the time of assembly, the first and second damping members 121, 122 are movable apart from or towards each other, and the refrigerant pipe 300 is snapped into the mounting hole 10 via the mounting opening 101, and then the first and second damping members 121, 122 are moved to be reset, which greatly reduces the assembly difficulty and improves the assembly efficiency.

In some embodiments of the present application, the mounting opening 101 of the mounting hole 10 at the first damping member 121 is formed at a side of the first damping member 121 adjacent to the second damping member 122, and the mounting opening 101 of the mounting hole 10 at the second damping member 122 is formed at a side of the second damping member 122 adjacent to the first damping member 121. During assembly, after the first damping member 121 is moved in a direction away from the second damping member 122, the refrigerant pipe 300 is snapped into the mounting hole 10 at the first damping member 121 via the mounting opening 101, and then the first damping member 121 is moved in the direction towards the second damping member 122 to reset the first damping member 121. After the second damping member 122 is moved in a direction away from the first damping member 121, the refrigerant pipe 300 is snapped into the mounting hole 10 at the second damping member 122 via the mounting opening 101, and then the second damping member 122 is moved in the direction towards the first damping member 121 to reset the second damping member 122. The structure is simple and the assembly is convenient.

For example, in the example of FIG. 4, the first and second damping members 121, 122 are arranged side by side at the connection base 11 in a left-right direction. The first damping member 121 is located at a right side of the second damping member 122, the mounting opening 101 of the mounting hole 10 at the first damping member 121 is formed at a left side of the first damping member 121, and the mounting opening 101 of the mounting hole 10 at the second damping member 122 is formed at a right side of the second damping member 122. During assembly, after the first damping member 121 is moved to the right, the refrigerant pipe 300 may be snapped into the mounting hole 10 at the first damping member 121 via the mounting opening 101 conveniently; after the second damping member 122 is moved to the left, the refrigerant pipe 300 may be snapped into the mounting hole 10 at the second damping member 122 via the mounting opening 101 conveniently. The structure is simple and the assembly is convenient.

According to some embodiments of the present application, the first and second damping members 121, 122 are spaced apart from each other. Thus, the elasticity of each of the first and second damping members 121, 122 may be increased, which moves the first and second damping members 121, 122 conveniently, facilitates the reduction in the difficulty of moving the first and second damping members 121, 121, and increases moving distances of the first and second damping members 121, 122, thereby further reducing the assembly difficulty and improving the assembly efficiency.

According to some embodiments of the present application, in a direction away from the damping body 12, a width of the connection base 11 is decreased gradually. For example, in the example of FIG. 4, in a direction from top to bottom, the width of the connection base 11 is decreased gradually. A section of the connection base 11 may be formed into a triangle, a trapezoid, or the like. Thus, the volume of the connection base 11 may be reduced, and then the volume of the damping pad 1 may be reduced, thereby preventing the damping pad 1 from interfering with other components inside the air conditioner 1000.

According to some embodiments of the present application, the damping pad 1 is configured as an integrally molded part. Thus, a processing technology may be simplified, a processing cost may be reduced, and an overall structural strength of the damping pad 1 may be improved.

According to some embodiments of the present application, the damping pad 1 is a silicone part, a rubber part or a plastic part. Thus, the elasticity of the damping pad 1 may be increased, and the noises generated when the refrigerant tube 300 is vibrated are effectively reduced. In assembly, the first and second damping members 121, 122 are movable apart from and towards each other by means of elastic deformation, which simplifies the structure of the damping pad 1, reduces the assembly difficulty, and improves the assembly efficiency.

According to some further embodiments of the present application, a fixation bracket 2 is further included, and is connected to the damping pad 1 and a housing of the air conditioner 1000. For example, referring to FIG. 2, the fixation bracket 2 may be connected to the damping pad 1 and a chassis 200 of the air conditioner 1000. Thus, the refrigerant pipe 300 may be fixed to the housing firmly by fixing the damping pad 1 to the housing of the air conditioner 1000 by means of the fixation bracket 2, which prevents the refrigerant pipe 300 from shaking when the air conditioner 1000 is operating, and further avoids the vibration and noises due to the contact of pipelines.

According to some embodiments of the present application, the fixation bracket 2 is connected with the damping pad 1 by a snapping assembly, the snapping assembly includes a snap 31 and a groove 32, the snap 31 is provided at one of the fixation bracket 2 and the damping pad 1, and the groove 32 is formed at the other of the fixation bracket 2 and the damping pad 1. Specifically, when the snap 31 is provided at the fixation bracket 2, the groove 32 may be formed at the damping pad 1; when the snap 31 is provided at the damping pad 1, the groove 32 may be formed at the fixation bracket 2. Thus, the damping pad 1 may be fixed at the fixation bracket 2 conveniently, and the structure is simple and the connection is reliable.

For example, in some embodiments of the present application, referring to FIGS. 3 to 6, the fixation bracket 2 is connected with the damping pad 1 by two snapping assemblies. The structure is simple and the connection is reliable.

Figure 7:
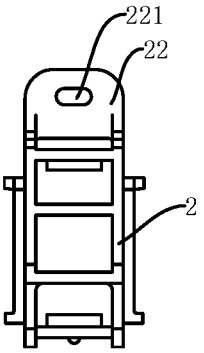
FIG. 7 is a top view of the fixation bracket of the damper assembly according to an embodiment of the present application.

In some embodiments of the present application, the fixation bracket 2 may be connected with the housing of the air conditioner 1000 by fasteners (for example, screws, bolts, rivets, or the like). For example, referring to FIGS. 2 and 7, the fixation bracket 2 is provided with a connection member 22 which is provided with a fixation hole 221, and the chassis 200 of the air conditioner 1000 is provided with a connecting hole corresponding to the fixation hole 221. In some other embodiments of the present application, the fixation bracket 2 may be welded to the housing of the air conditioner 1000.

According to some embodiments of the present application, the fixation bracket 2 is formed with an accommodation groove 21 with an opening facing downward, and the damping pad 1 is adapted to be accommodated in the accommodation groove 21. Thus, the damping pad 1 may be limited by the accommodation groove 21, such that the connection between the fixation bracket 2 and the damping pad 1 is more stable and reliable, thereby firmly fixing the refrigerant pipe 300 to the housing, preventing the refrigerant pipe 300 from shaking during the operation of the air conditioner 1000, and avoiding the vibration and noises caused by the contact of the pipelines.

According to some embodiments of the present application, at least one inner wall surface of the accommodation groove 21 is in an abutting fit with the damping pad 1. That is, one or more inner wall surfaces of the accommodation groove 21 is in an abutting fit with the damping pad 1, or each of the inner wall surfaces of the accommodation groove 21 is in an abutting fit with the damping pad 1. Thus, the connection reliability of the fixation bracket 2 and the damping pad 1 may be further improved.

According to some embodiments of the present application, the fixation bracket 2 is configured as a plastic part, a sheet metal part, a rubber part, or a silicone part, which realizes easy processing and low costs.

The air conditioner 1000 consistent with embodiments of the second aspect of the present application includes the damping assembly 100 consistent with embodiments of the first aspect of the present application. As shown in FIG. 1, the air conditioner 1000 may be configured as a window air conditioner, but is not limited thereto.

In the air conditioner 1000 consistent with embodiments of the second aspect of the present application, by providing the damping assembly 100 consistent with embodiments of the above-mentioned first aspect of the present application, the noises caused by the contact of the refrigerant pipes 300 during the operation of the air conditioner 1000 are reduced, and the use comfortability of the air conditioner 1000 is improved. At the same time, the structure of the air conditioner 1000 may be made more compact and the reduction of an overall volume of the air conditioner 1000 is facilitated.

In the description of the present specification, reference throughout this specification to "an embodiment," "some embodiments," "exemplary embodiment," "example," "specific example" or "some examples" means that a particular feature, structure, material, or characteristic described in connection with the embodiment or example is included in at least one embodiment or example of the present disclosure. In the specification, the schematic expressions to the above-mentioned terms are not necessarily referring to the same embodiment or example. Furthermore, the described particular features, structures, materials, or characteristics may be combined in any suitable manner in one or more embodiments or examples.

Although embodiments of the present disclosure have been shown and illustrated, it shall be understood by those skilled in the art that various changes, modifications, alternatives and variants without departing from the principle and idea of the present disclosure are acceptable. The scope of the invention is defined by the claims and its equivalents. cm What is claimed is:

What is claimed is:

1. An assembly comprising:

a pad including:

a connection base; and a body connected to the connection base and extending in an extension direction away from the connection base, the body including:

a first member including a plurality of first mounting holes; and a second member including at least one second mounting hole, the plurality of first mounting holes and the at least one second mounting hole being configured to hold refrigerant pipes of an air conditioner, and each of the plurality of first mounting holes and the at least one second mounting hole including a mounting opening configured to allow one of the refrigerant pipes to be snapped through;

wherein:

a direction pointing from a center of one of the plurality of first mounting holes to a center of another one of the plurality of first mounting holes is parallel to the extension direction of the body; and the plurality of first mounting holes and the at least one second mounting hole are all arranged at a same side of the connection base along the extension direction of the body;

a fixation bracket configured to be connected to the pad and to a housing of the air conditioner, the fixation bracket including an accommodation groove having an open side and a closed side opposite to each other, with the open side facing the connection base, and the pad is accommodated in the accommodation groove; and a snapping assembly configured to connect the fixation bracket with the pad, the snapping assembly including:

a snap at the fixation bracket and;

a groove at the pad.

2. The assembly according to claim 1, wherein one end of the first member and one end of the second member are connected to the connection base, and another end of the first member and another end of the second member are movable in directions apart from and towards each other.

3. The assembly according to claim 2, wherein:

on the first member, the mounting opening of each of the plurality of first mounting holes is formed at a side of the first member that is adjacent to the second member; and on the second member, the mounting opening of each of the at least one second mounting hole is formed at a side of second member that is adjacent to the first member.

4. The assembly according to claim 2, wherein the first member and the second member are spaced apart from each other.

5. The assembly according to claim 2, wherein in a direction away from the body, a width of the connection base decreases.

6. The assembly according to claim 2, wherein an opening direction of the mounting opening of each of the plurality of first mounting holes on the first member is opposite to an opening direction of the mounting opening of each of the at least one second mounting hole on the second member.

7. The assembly according to claim 1, wherein the pad is configured as an integrally molded part.

8. The assembly according to claim 1, wherein the pad includes a silicone part, a rubber part, or a plastic part.

9. The assembly according to claim 1, wherein at least one inner wall surface of the accommodation groove abuts against and is fitted with the pad.

10. The assembly according to claim 1, wherein the fixation bracket includes a plastic part, a sheet metal part, a rubber part, or a silicone part.

11. The assembly according to claim 1, wherein a distance between two opposite ends of the connection base in a first direction perpendicular to a second direction away from the body decreases in the second direction.

12. The assembly according to claim 1, wherein the connection base has a triangle or trapezoid shape in a plane parallel to the extension direction of the body.

13. An air conditioner comprising:

a plurality of refrigerant pipes; and an assembly including:

a pad including:

a connection base; and a body connected to the connection base and extending in an extension direction away from the connection base, the body including:

a first member including a plurality of first mounting holes; and a second member including at least one second mounting hole, the plurality of first mounting holes and the at least one second mounting hole being configured to hold the refrigerant pipes, and each of the mounting holes including a mounting opening configured to allow one of the refrigerant pipes to be snapped through;

wherein:

a direction pointing from a center of one of the plurality of first mounting holes to a center of another one of the plurality of first mounting holes is parallel to the extension direction of the body; and the plurality of first mounting holes and the at least one second mounting hole are all arranged at a same side of the connection base along the extension direction of the body;

a fixation bracket configured to be connected to the pad and to a housing of the air conditioner, the fixation bracket including an accommodation groove having an open side and a closed side opposite to each other, with the open side facing the connection base, and the pad is accommodated in the accommodation groove; and a snapping assembly configured to connect the fixation bracket with the pad, the snapping assembly including:

a snap at the fixation bracket and;

a groove at the pad.

14. The air conditioner according to claim 13, wherein one end of the first member and one end of the second member are connected to the connection base, and another end of the first member and another end of the second member are movable in directions apart from and towards each other.

15. The air conditioner according to claim 14, wherein:

on the first member, the mounting opening of each of the plurality of first mounting holes is formed at a side of the first member that is adjacent to the second member; and on the second member, the mounting opening of each of the at least one second mounting hole is formed at a side of second member that is adjacent to the first member.

16. The air conditioner according to claim 14, wherein the first member and the second member are spaced apart from each other.

* * * * *